United States Patent [19]

Diehl et al.

[11] Patent Number: 5,076,957

[45] Date of Patent: Dec. 31, 1991

[54] PHOSPHATE-FREE DETERGENT BUILDERS

[75] Inventors: Manfred Diehl; Wolfgang Leonhardt, both of Frankfurt; Gerhard Morlock, Hanau; Maurizio Ragnetti, Mainz-Kastell, all of Fed. Rep. of Germany

[73] Assignee: Degussa Aktiengesellschaft, Frankfurt am Main, Fed. Rep. of Germany

[21] Appl. No.: 474,658

[22] Filed: Feb. 6, 1990

Related U.S. Application Data

[63] Continuation of Ser. No. 189,811, May 3, 1988, abandoned.

[30] Foreign Application Priority Data

May 6, 1987 [DE] Fed. Rep. of Germany ..... 3715051

[51] Int. Cl.[5] ..... C11D 3/12; C11D 3/37

[52] U.S. Cl. ..... 252/174.24; 252/174.25; 252/DIG. 2; 252/DIG. 15; 252/174.23

[58] Field of Search ..... 252/174.24, 174.25, 252/174.23, 135, DIG. 2, DIG. 15

[56] References Cited

U.S. PATENT DOCUMENTS

| | | | |
|---|---|---|---|
| 3,782,898 | 1/1974 | Mandell | 8/137 |
| 3,962,132 | 6/1976 | Haschke et al. | 252/430 |
| 4,249,903 | 2/1981 | Smolka et al. | 252/174.25 |
| 4,428,749 | 1/1984 | Morris | 8/137 |
| 4,519,933 | 5/1985 | Gresser et al. | 252/174.25 |
| 4,604,224 | 8/1986 | Cheng | 252/91 |
| 4,668,420 | 5/1987 | Diehl et al. | 252/135 |
| 4,683,073 | 7/1987 | Diehl | 252/135 |
| 4,695,284 | 9/1987 | Hight | 8/137 |
| 4,702,858 | 10/1987 | Denzinger et al. | 252/174.24 |
| 4,707,290 | 11/1987 | Seiter et al. | 252/174.24 |
| 4,883,607 | 11/1989 | Diehl | 252/174.18 |

FOREIGN PATENT DOCUMENTS

| | | |
|---|---|---|
| 0108429 | 9/1983 | European Pat. Off. . |
| 0137669 | 8/1984 | European Pat. Off. . |

OTHER PUBLICATIONS

Colloid 119/50, Colloids, Inc., 394 Frelinghuysen Ave., Newark, N.J. 07114, May 1979.

Multi-Functional Polyacrylate Polymers in Detergents, M. K. Nagarajan, JAOCS, vol. 62, No. 5, May 1985.

Acrylate Detergent Polymers in Industrial and Institutional Detergents, David Witiak, Ph.D., Chemical Times & Trends, pp. 40–45, Oct. 1986.

*Primary Examiner*—Hoa Van Le

*Attorney, Agent, or Firm*—Beveridge, DeGrandi & Weilacher

[57] ABSTRACT

The detergent builder consists of a water-insoluble silicate capable of binding calcium ions as well as of a mixture of two acrylic acid polymerizates which exhibit different viscosity numbers.

6 Claims, No Drawings

PHOSPHATE-FREE DETERGENT BUILDERS

This application is a continuation of application Ser. No. 07/189,811, filed May 3, 1988, now abandoned.

The present invention relates to a phosphate-free detergent builder.

The addition of mixtures of zeolite A and a mixture of a homopolymeric and of a copolymeric acrylic acid in detergents is known (cf. DE-OS 34 44 960) corresponding to U.S. Pat. No. 4,707,290.

Furthermore, the addition of polyacrylic acids with different molecular weights in detergents is also known (cf. EP-OS 108,429).

SUMMARY OF THE INVENTION

The subject matter of the invention relates to a phosphate-free detergent builder formed of a water-insoluble silicate capable of binding calcium ions as well as a mixture of two different acrylic acid polymerizates which exhibit a different viscosity number.

Preferably, the mixture of the two different acrylic acid polymerizates can consist of two homopolymerizates.

In another embodiment of the invention, the mixture of the two acrylic acid polymerizates can be composed of a homopolymerizate and of a copolymerizate.

In a further embodiment of the invention, the mixture of the two acrylic acid polymerizates can be formed of two different copolymerizates.

In a preferred embodiment of the invention, the acrylic acid polymerizates can exhibit a viscosity number of 15 to 60, especially between 20 and 35, and from 80 to 200, especially between 90 and 120.

In a preferred embodiment of the invention, a finely distributed, synthetically prepared, water-insoluble compound of the general formula $$(Kat_{2/n}O)_x.Me_2O_3.(SiO_2)_y \quad (I)$$

which contains bound water and in which Kat signifies a cation of valence n which can be replaced with calcium, x signifies a number from 0.7 to 1.5, Me signifies boron or aluminum and y signifies a number from 0.8 to 6 can be added as water-insoluble silicate capable of binding calcium ions.

Aluminum silicates (AS) are used with particular preference.

The aluminum silicates to be added can be amorphous or crystalline products. Mixtures of amorphous and of crystalline products and also partially crystalline products can of course also be added. The aluminum silicates can be naturally occurring products or also synthetically prepared products. The synthetically prepared products are preferred. The preparation can occur e.g. by reacting water-soluble silicates with water-soluble aluminates in the presence of water. To this end, aqueous solutions of the initial materials can be mixed with each other or a component present in a solid state can be reacted with the other component present as aqueous solution. The desired aluminum silicates are also obtained by mixing both components present in a solid state in the presence of water. Aluminum silicates can also be prepared from $Al(OH)_3$, $Al_2O_3$ or $SiO_2$ by reacting them with alkali silicate solutions or aluminate solutions. The preparation can also be performed according to other known methods. In a particular aspect, the invention relates to aluminum silicates which exhibit a three-dimensional spatial lattice structure.

The preferred calcium binding capacity, resides approximately in a range of 100 to 200 mg CaO/g AS, usually at approximately 100 to 180 mg CaO/g AS, is found in particular in compounds of the composition:

$$0.7-1.1Na_2O.Al_2O_3.1.3-3.3SiO_2.$$

This empirical formula encompasses two types of different crystal structures (and their non-crystalline initial products) which also differ from each other by their empirical formulas. They are:

$$a)0.7-1.1Na_2O.Al_2O_3.1.3-2.4SiO_2$$

$$b)0.7-1.1Na_2O.Al_2O_3.2.4-3.3SiO_2.$$

The different crystal structures are apparent in an X-ray diffraction diagram.

The amorphous or crystalline aluminum silicate present in aqueous suspension can be separated by filtration from the remaining aqueous solution and dried at temperatures of e.g. 50° to 400° C. The product contains more or less bound water, depending on the drying conditions.

Such high drying temperatures are generally not to be recommended; it is advantageous if 200° C. is not exceeded when the aluminum silicate is intended for use in detergents and cleaning agents. However, the aluminum silicates do not have to be dried at all after their preparation in order to be suitable for a suspension in accordance with the invention; rather, an aluminum silicate which is still moist from the preparation can be used, which is especially advantageous. However, aluminum silicates dried at middle temperatures, e.g. at 80° to 200° C. until removal of the adhering, liquid water can also be used for preparing suspensions in accordance with the invention.

The particle size of the individual aluminum silicate particles can be different and be in a range of, for example, between 0.1μ and 0.1 mm. This indication refers to the size of the primary particles, that is, the size of the particles which accumulate during the precipitation and optionally during the crystallization that follows. It is especially advantageous to use aluminum silicates are composed of at least 80% by weight of particles with a size of 10 to 0.01μ, especially of 8 to 0.1μ.

These aluminum silicates preferably contain no more primary or secondary particles with diameters above 45μ. Particles which were created by means of agglomeration of the primary particles to larger structures are designated as secondary particles.

As regards the agglomeration of primary particles to larger structures, the use of aluminum silicates which are still moist from their preparation for preparing the suspensions of the invention has proven to be especially beneficial. It has been observed that when these still-moist products are used, a formation of secondary particles is practically completely eliminated.

In an especially preferred embodiment of the invention, powdery zeolite of type A with an especially defined particle spectrum is used as component A.

Such zeolite powders can be prepared according to DE-AS 24 47 021, DE-AS 25 17 218, DE-OS 26 52 419, DE-OS 26 51 420, DE-OS 26 51 436, DE-OS 26 51 437, DE-OS 26 51 445, DE-OS 26 51 485. They then exhibit the particle distribution curves indicated in these publications.

In an especially preferred embodiment, a powdery zeolite of type A can be used which exhibits the particle size distribution described in DE-OS 26 51 485.

The polymerizates which arise can be used both as acid as well as salt and as a partially neutralized substance; metal ions and nitrogenous cations are suitable as counterions.

The acrylic acid polymerizates used in the detergent builder of the invention are homopolymerizates of acrylic acid or copolymerizates of acrylic acid with a content of at least 50 mole % acrylic acid. The copolymerizates can contain other ethylenically unsaturated mono or dicarboxylic acids with 3–8 C atoms such as e.g. methacrylic acid, itaconic acid or maleic acid and its anhydride as further monomers. The portion of these monomers containing carboxyl groups in the copolymer can be up to 50%. In addition, the copolymerizates can contain ethylenically unsaturated monomers free of carboxyl groups up to a portion of 20 mole %.

Specifically, the following are cited by way of example as monomers free of carboxyl groups: Acrylamide, methacrylamide, 2-acrylamido-2-methylpropane sulfonic acid, vinyl sulfonic acid, allyl sulfonic acid, vinyl phosphonic acid, allyl phosphonic acid, vinyl acetate, vinyl propionate, esters of acrylic acid or of methacrylic acid with 1–8 C atoms in the alcohol group such as methylmethacrylate, ethylmethacrylate, butylmethacrylate, methylacrylate, ethylacrylate, butylacrylate, ethylhexylacrylate, hydroxyethyl(meth)acrylate, hydroxypropyl(meth)acrylate, dialkylaminoethyl(meth)acrylate, vinyl glycol, allyl alcohol, ethylene, propylene, iso-butylene, methol-vinyl ether, ethyl-vinyl ether, isobutylvinylether, styrene or butadiene.

The acrylic acid polymerizates are prepared according to known methods.

Such methods are described e.g. in "Acrylic Acid Polymers", M. L. Mitter, Encyclopedia of Polymer Science and Technology, vol. 1, Interscience Publishers, New York, 1964.

The preparation of the homo or copolymers can be performed by means of all customary radical polymerization methods. For example, the following are cited as methods of preparation:

Solution polymerization, whereby the monomers are dissolved in water or in another solvent or solvent mixture with possible additives of low-molecular organic and/or inorganic compounds.

Precipitation polymerization in such solvents in which the monomers are at least partially soluble and the polymerizates are not soluble.

Emulsion polymerization and suspension polymerization in such solvents in which the monomers are not soluble and the emulsions or suspensions are stabilized by the addition of low and/or high-molecular substances.

The monomer concentration ranges between 5% and 70%, wherein 25% to 50% is preferred, according to the viscosity of the polymer solution being produced.

Suitable initiators are both thermally decomposable radical donors which exhibit a sufficient solubility in the desired solvent or in the monomer and also multi-component redox initiators.

A polymerization induced by radiation can also be used for preparing the acrylic acid polymerizates.

The polymerization temperature is used together with the amount of initiator to control the molecular weight of the desired polymerizate. It ranges between 30° and 180° C., whereby it is advantageous to maintain it between 60° and 120° C. Low temperatures usually bring high-molecular polymerizates which are too high and too low temperatures can cause polymer breakdown and coloration.

The molecular weight can also be controlled by means of suitable regulators such as thio derivatives and low-molecular alcohols. A relative measure for the average molecular weight is the viscosity number (ml/g).

The polymer mixture of the invention contains at least one homo or copolymer (a) with a viscosity number (VZ) between 15 and 60, preferably between 20 and 35, and one homo or copolymer (b) with a VZ between 80 and 200, preferably between 90 and 120. The ratio of a/b varies between 1/99 and 99/1, preferably between 25/75 and 75/25.

The preparation of the invention can be carried out by mixing the separately prepared polymerizates, or also in a single, synthetic step, whereby the polymers with different molecular weight or different viscosity are produced in chronological succession by means of controlling the dosing time of the various components, the reaction temperature and the reaction time.

The polymer mixture or the polymers prepared in a single step exhibit the same physical, chemical and application properties.

The viscosity number is a known value. Its determination is described in testing specification DIN 53727.

The viscosity number of the various acrylic acid polymerizates used in accordance with the invention is determined according to the known DIN specification as follows:

I. METHOD

An aqueous solution (2 g polymerizate in 100 $cm^3$ 0.1M of NaBr pH=10.0) is prepared from aqueous polycarboxylic acid Na salt solution, taking into consideration the solid content and in the case of polycarboxylic acids after weight correction to polycarboxylic acid Na salt (determination of the acid value). The viscosity number of this solution is determined in an Ubbelohde viscosimeter capillary Oa at 25° C.

II. DEVICES

Viscotimer (Schott)
Measuring stand (Schott)
Viscotimer frame of V4A steel
Ubbelohde viscosimeter capillary Oa
Lauda see-though thermostat D40-SN
Evaluation can be performed with an HP 97 S computer using a suitable program The viscosity number (ml/g) is a relative measure for the average molecular weight and for the average degree of polymerization.

The viscosity number VZ $cm^3/g$ is the relative viscosity change divided by the concentration c ($g/cm^3$) of the solution.

$$VZ = \left(\frac{n}{n_o} - 1\right) \cdot \frac{1}{c} ; \left(\frac{cm^3}{g}\right)$$

Instead of the dynamic viscosity of the polymer solution and the dynamic viscosity $_0$ of the solvent, the retention times t of the measuring solution and $t_0$ of the solvent are used in practice for determining the viscosity number VZ and are calculated according to the following formulas:

$$VZ = \frac{t}{t_o} - 1 \Big) \cdot \frac{1}{c} \text{ ; (cm}^3\text{/g)} \quad (2)$$

The concentration c is given with 2.0 g/100 cm$^3$; thus, a single-point measurement is involved. Consequently, the VZ is only defined if capillary, capillary constant, concentration, solvent and measuring temperature are indicated.

The measured outflow times must be corrected by $\Delta t$ according to Hagenbach.

$$\Delta t = \frac{A}{t^2} \text{ ; Hagenbach correction} \quad (3)$$

$$A = 5.595 \cdot k^{-1.625} \text{ ;} \quad (4)$$

$$t \text{ corr} = t - \Delta t; \quad (5)$$

$$t_o \text{ corr} = t_o - \Delta t_o; \quad (6)$$

$$VZ - \frac{t - \Delta t}{t_o - \Delta t_o} - 1 \Big) \cdot \frac{1}{c} \text{ ; (cm}^3\text{/g)} \quad (7)$$

$$VZ \frac{t \text{ corr}}{t_o \text{ corr}} - 1 \Big) \cdot \frac{1}{c} \text{ ; (cm}^3\text{/g)} \quad (8)$$

Relative viscosity $t/t_0$

This dimensionless number represents the ratio of the outflow time of the polymer solution (t corr) and of the solvent ($t_0$ corr) and is the basis for the calculation of VZ.

$$eta\text{-}rel = \frac{t}{t_o} = \frac{t \text{ corr}}{t_o \text{ corr}} \quad (9)$$

Here too, the result is a function of the measuring conditions. In general, eta-rel should not exceed a value of 2 since otherwise another polymer concentration or another capillary must be selected.

The limiting viscosity number and the average molecular weight M can be calculated from the VZ.

Calculation of the limiting viscosity number $\eta$ $$\eta = \frac{VZ}{1 + K_{SB} \cdot c \cdot VZ} \quad (10)$$

$K_{mm}$=0.15 for PAS and POC
c=measured concentration in g/cm$^3$

Calculation of the average weight mean of the molecular weight in the case of PAS and POC HS $$\eta = K \cdot M_w^a \quad PAS_{20}^{\bullet} \quad K = 0.283$$
$$a = 0.755$$

$$\log M_w = \frac{\log \frac{n}{k}}{a}$$

Measuring principle

This involves a time measurement. The retention time $t_0$ of the solvent (0/1M aqueous NaBr pH=10.0) is measured in an Ubbellohe capillary viscosimeter with capillary Oa and at 25.0° C. This time measurement of 0.01 sec. takes place with an AVS/ST measuring stand equipped with two light barriers.

The retention time t of the measuring (polymer) solution is determined in the same viscosimeter. The measuring solution contains 2.0 g (POC solid calculated on OS) per 100 cm$^3$ in 0/1M NaBr pH=10.0.

The Hagenbach correction ($\Delta t$; sec.) must be calculated for these two retention times by which the times t and $t_0$ must be corrected (equations 3; 4). The characteristic quantity for the average molecular weight —viscosity number=VZ(cm$^3$/g);

is calculated from the corrected retention times measured value t corr and blank reading $t_0$ corr and from the concentration c (g/100 cm$^3$) (equation 8).

Performance

Measuring conditions

Capillary Oa
Measuring temperature 25° C. 0.01° K.
Solvent: 0.1M NaBr aqueous pH=10.0 0.05
Polymer concentration of the measuring solution: 2.000 0.02 of polycarboxylic acid
Na salt
Time measurement: at 0.01 sec. (light barrier)
Number of measurements: 3 (3 values are required for the computer program)

Solvent: 50 ml
0.1 *M* NaBr pH = 10.0

The correction according to Hagenbach is not performed.

Weight of the polymer solution
1, the solid content and
2, the type of the polymer (whether the polymer is present as
acid=POC HS PAS
neutral=POC-AS
or as
Na salt=POC-OS PAS-N)
must be considered in the weight for the measuring solution for VZ.

Weight in the case of POC-HS and PAS-S

The solid content of the POC-HS or PAS* is to be determined according to AV 318.1.

The acid value of the POC-HS or PAS* is to be determined according to AV 319.1.

*S $$\text{Weight in g} = \frac{1.0000 \cdot \frac{100}{\%\text{ solid}}}{1 + \frac{0.393 \cdot SZ - F}{100}} \quad \text{for 50 ml measuring solution}$$

0.393=correction factor, since polycarboxylic acid is weighed but the measuring solution must be 2% polycarboxylic acid Na salt.

SZ-F=acid value solid matter in mgKOH/g determined according to AV 319.1.

Weight in the case of POC-OS and PAS-N is already present as polycarboxylic acid Na salt and is corrected only for solid matter. The same applies to the POC-AS type!

$$\text{Weight in g: } \frac{1.0000 \cdot 100}{\%\ \text{solid}} \quad \text{for 50 ml measuring solution}$$

Preparation of the measuring solution

B g POC solution is weighed in a 100 ml beaker glass (calculation of the precise weight)

in the case of POC-HS (PAS-S) according to 6.2.1 in the case of POC-AS according to 6.2.2 in the case of POC-OS (PAS-N) according to 6.2.2

After adding approximately 20 ml dist. $H_2O$ and pipetting in 5 ml 1M NaBr solution, the mixture is dissolved cold under agitation. The pH is measured with a bent digital pH meter (electrode EA 121) (in the case of HS pH approximately 2–3, for OS pH approximately 7–8) and a pH of 10.0 0.05 is set under agitation by adding in NaOH. One hour after the last addition of NaOH, the pH is checked again and corrected if necessary.

SZ-F: 0 is added in program step 7 for weight calculation point 6.2.2 in the case of POC-OS, POC-AS and PAS-N (thus, from polycarboxylic acid Na salts).

The viscosity number is calculated according to the formula $$VZ = \frac{1}{c} \cdot \frac{t}{(t_o - 1)} \quad \frac{\text{ml}}{\text{g}}$$

wherein c = concentration of the PAS NA salt measuring solution in g/cm$^3$ t = retention time of the polymer solution $t_0$ = retention time of the binding value The limiting viscosity number $\eta$ is calculated according to the following formula:

$$\eta = \frac{VZ}{1 + K_{SB} \cdot c \cdot VZ}$$

$D_{SB}$ = constant for PAS and POC equal to 0.15.

$K_{SB} = 0.15$

The average weight mean of the molecular weight can be computed as follows:

$$= K \cdot Mw^{a}$$

$$\text{Log } Mw = \frac{\log \frac{\eta}{k}}{a}$$

The detergent builder of the invention exhibits the following advantages:

Very good calcium binding capacity

Very good anti-redisposition action

Very good inhibition of heating rod incrustations

Very good inhibition of fabric incrustations.

Whereas the phosphate-free detergent builder of the invention, which is balanced in all four points, displays excellent advantages, the known detergent builders are only advantageous in individual points in an unbalanced manner.

DETAILED DESCRIPTION OF THE INVENTION

Examples a) Determination of the viscosity number (VZ)

The VZ is measured with an Ubbelohde capillary viscosimeter with capillary Oa at 25° C. The retention time of a 2% (weight) polymer solution in 0.1 molar NaBr at pH 10 is measured. The pH is set by adding NAOH. The difference between the retention time of the specimen and that of the pure solvent divided by the polymer concentration of the measured specimen is designated as VZ.

b) Examples for preparing the polymers

The parts indicated in the following are to be understood as parts by weight. The reactor can be equipped with a thermostat, is designed for a pressure up to 10 bars and is provided with agitators and supply lines for the various components.

Example 1

250 parts deionized water are put in a receiver with 2.6 parts 50% $H_2O_2$ and heated to 90° C. 415 parts acrylic acid and 11 parts sodium peroxodisulfate dissolved in 720 parts deionized water are dosed in separately from one another for 2 hours at 90° C. 1.5 hours postreaction time follow at the same temperature. A polymer with VZ = 100 cm$^3$/g is produced.

Example 2

185 parts deionized water are placed in a receiver and heated to 100° C. 200 parts acrylic acid and 16.7 parts sodium peroxodisulfate dissolved in 100 parts deionized water are supplied separately from one another at constant temperature for 2 hours. 1 hour postreaction follows at 100° C. A polymer with VZ = 24 cm$^3$/g is produced.

Example 3

80 parts deionized water are placed in a receiver. A pressure of 3.5 bars is set under an atmosphere of nitrogen and the reactor contents heated to 135° C. 60 parts deionized water, 19 parts 50% $H_2O_2$ and 80 parts acrylic acid are added under these conditions within 4 hours through separate lines. 2 hours postreaction follow while the temperature drops to 90° C. A polymer with VZ = 14 cm$^3$/g is produced.

c) Testing of the detergent builder of the invention in detergents

The detergents are prepared in a Telschig spray mixer. The surface active agents are hot-sprayed together with the optical brighteners. Then they are powdered with Sikalon D, enzyme, behenic soap, tallow soap and tallow alcohol.

For recipes, see table 1.

The washing tests are performed in 3 Miclo washing machines W763 in cyclic alternation at a water hardness of approximately 20° dH and a washing temperature of 60° C. in a hot/colors program for 25 washes.

The charged fabric consists of 3 kg terry cloth and cotton fabric.

150 g wash powder is dosed in per wash for the preliminary and the main wash.

White towels (washed twice in advance at 95° C.) with sewn-on stains (approximately 22×15 cm) are added as wash test fabric. Two stains are sewn on each towel on alternating sides.

The following stains were used;

EMPA—standard 2)

WFK—tea 1)

WFK—sebaceous matter 1)

EMPA—red wine 2)

EMPA—sulfur black 2)

1) WFK = Wäschereiforschung Krefeld [Krefeld {city} Laundry Testing], Krefeld (Germany)

2) EMPA = Eidgenössische Materialprüfungsanstalt [Swiss Materials Testing Institute], St. Gallen, (Switzerland)

In order to harden the mixture of liquids, a strip approximately 22×15 cm with the following stains is put in every second wash:

EMPA—standard

EMPA—blood

EMPA—tea

EMPA—sulfur black

2½ towels (approximately 550 g) are added with the stains for a detergent and colorimetrically evaluated after the first wash. The primary washing capacity is determined with one wash per machine—a total of 3 primary washes.

In order to determine the secondary washing capacity, a strip of cotton and terry cloth fabric is washed at the same time for each detergent and the inorustation values are determined after 25 washes.

Terry cloth and cotton: 1 h at 1000° C. incinerated Towel: 2 h at 1000° C. incinerated.

The degree of greying was measured on cotton with green strips (WFK) after the 10th and the 25th wash.

The colorimetric evaluation takes place on a filter color measuring device RFC 3 (Zeiss). The degree of whiteness according to Berger is used for evaluation.

The evaluation takes place under statistical viewpoints. In order to keep the measuring expense within reasonable limits (measuring area: 3 cm ∅, measuring time: approximately 2' per measuring point), the following measuring points are taken.

Primary wash: 3 points per stain, that is, a total of 9 points with 3 repetitions.

Greying: each 3 measuring points.

After testing for outliers (1), mean [or "average"] values $\bar{x}_i$ and standard deviation $S_i$ are determined (2). Significant differences are determined by determining the LSD value (least significant difference) (3):

a) Equal sampling size $n_i$=const.

$$LSD = \sqrt{\frac{2}{n_1} \cdot S_{in}^2 \cdot F_1, n - k; \alpha}$$

b) Unequal sampling size $n_i \neq$const.

$$LSD_{(a,b)} = \sqrt{\frac{n_a + n_b}{n_a \cdot n_b} \cdot S_{in}^2 \cdot F_1; n - k; \alpha}$$

$$n = \sum_{i=1}^{k} n_1 \text{ (sum of all measured values)}$$

$k$ = number of groups (here: 8)

$F_1; n - k; \alpha$ = Table value for the so-called "$F$ test"

(application: variant analysis, etc.); used here at the 5% error level ($\alpha$=0.05)

(1) Lothar Sachs, Angewandte Statistik [Applied Statistics], 4th edition, Springer Verlag, 1973, pp. 219–221.

(2) ibid., pp. 57, 58.

(3) ibid., p. 394; tables on pp. 116–124.

$S_{in}^2$ in is designated as "variance within the group" (average value of the squared deviations of the individual values around the average group values) and is calculated according to the following formula from the individual standard deviations $S_i$ of the group (4).

(4) ibid., pp. 63, 386–389

$$S_{in}^2 = \sum_i \frac{(S_1^2 (n_1 1))}{n - k}$$

The average values $\bar{x}_i$ are ordered according to decreasing magnitude and the average value differences tested for significance using the LSD criterion. Nonsignificant difference are shown by underlining the average values with a common line.

The test of Wilcoxon-Wilcox (multiple average value comparisons using ranking numbers) (5) is performed for a total evaluation of the primary washing capacity.

(5) ibid., pp. 426–429

An order of precedence of 1–8 (equal average values receive an "average" ranking number) are set up for each stain for the 8 recipes and the individual ranks for each recipe are added. The differences of these ranking sums are checked for significance by comparison with tabulated values (5% level).

No differences could be determined in the primary washing capacity (tables 2 and 3) and up to recipes 4 and 7 with the PAS VZ=9. This is an indication of the known fact that the main action of PAS or of the polymers in general resides in the improvement of the detergent as regards the secondary washing capacity.

A distinct graduation in the spectrum of action of PAS is exhibited in the greying (table 4). It was surprisingly found that significantly better degrees of whiteness can be obtained with polymer mixtures than with the individual PAS, especially in comparison to the two products customary on the market (recipes 1,8). This behavior clearly indicates synergistic effects which only become active in the mixtures.

This behavior is also reflected in the differences between the 10th and the 25th wash. Mixtures of PAS exhibit a distinct recall of the degree of whiteness whereas the individual PAS, on the other hand, exhibit a slight decrease.

The mentioned synergism exhibits a distinct effect in the incrustation values. In particular, the mixture of recipe 6 of the invention consisting of 50 parts PAS VZ=100 (example 1) and 50 parts PAS VZ=24 (example 2) results especially in close-woven cotton fabric in a significant decrease of the incrustation values. The values with PAS VZ=9 (see recipes 4,7) are unexpectedly high. This indicates a lower limit for the optimum VZ range for the low-molecular PAS component in PAS mixtures.

TABLE 1 recipes of test detergents 1–8 (data in percent)

| | |
|---|---|
| Alkyl benzene sulfonate | 3.5 |
| alkyl sulfane, $C_{16}/C_{18}$ | 3.5 |
| Na-toulene sulfonate | 0.8 |
| Tallow alcohol 5 EO | 2.0 |
| Oxoalcohol 9 EO, $C_{13}/C_{15}$ | 2.0 |
| Tallow soap | 2.0 |
| Behenic Soap | 2.0 |
| Tallow alcohol | 0.5 |
| Zeolite A | 26.3 |
| Polymer*) | 2.0 |
| Na-disilicate | 6.0 |
| Na-perborate tetrahydrate | 19.0 |
| CMC | 1.5 |
| EDTA | 0.2 |
| ENZYM [enzyme] (protease) | 0.2 |

TABLE 1-continued

| recipes of test detergents 1-8 (data in percent) | |
|---|---|
| Opt. brightener | 0.2 |
| Na-sulfate | 10.5 |
| Water | 9.2 |

*)polymer
Nr. 1: PAS from example 1, VZ = 100, commercial product
Nr. 2: PAS, VZ = 60
Nr. 3: PAS from example 2, VZ = 24
Nr. 4: PAS, VZ = 9
Nr. 5: Mixture of 50 parts PAS VZ = 100 and 50 parts PAS VZ = 60
Nr. 6: Mixture of 50 parts PAS VZ = 100 and 50 parts PAS VZ = 24
Nr. 7: Mixture of 50 parts PAS VZ = 100 and 50 parts PAS VZ = 9
Nr. 8: Commercially available acrylic acid/maleic acid copolymerizate, VZ = 44

TABLE 2

| Primary washing capacity Degree of whiteness according to Berger, Δ values | Recipe | | | | | | | | | | | | | | | | | |
|---|---|---|---|---|---|---|---|---|---|---|---|---|---|---|---|---|---|---|
| | 1 | | 2 | | 3 | | 4 | | 5 | | 6 | | 7 | | 8 | | | |
| Stain | $\bar{x}_1$ | $\pm S_1$ | $\bar{x}_2$ | $\pm S_2$ | $\bar{x}_3$ | $\pm S_3$ | $\bar{x}_4$ | $\pm S_4$ | $\bar{x}_5$ | $\pm S_5$ | $\bar{x}_6$ | $\pm S_6$ | $\bar{x}_7$ | $\pm S_7$ | $\bar{x}_8$ | $\pm S_8$ | $S_{iN}^2$ | LSD |
| EMPA - stand. | 53,2 | 5,36 | 45,8 | 4,46 | 51,4 | 3,05 | 29,3 | 3,34 | 46,3 | 4,77 | 43,4 | 5,48 | 27,2 | 6,69 | 49,9 | 6,70 | 30,28 | , 3 |
| WFK - tea | 115,0 | 3,03 | 112,8 | 1,18 | 120,3 | 5,91 | 78,1 | 8,46 | 99,6 | 8,51 | 101,2 | 8,14 | 78,5 | 7,41 | 94,4 | 4,72 | 41,62 | 6,07 |
| WFK - seb. mat. | 89,4 | 2,35 | 79,5 | 5,75 | 86,0 | 2,98 | 67,9 | 4,57 | 90,1 | 7,38 | 91,7 | 6,80 | 53,2 | 4,14 | 95,9 | 4,95 | 26,34 | 4,83 |
| EMPA - red wine | 76,1 | 3,80 | 72,7 | 5,22 | 81,1 | 5,02 | 63,2 | 8,83 | 72,8 | 5,70 | 72,9 | 9,42 | 63,4 | 12,27 | 68,2 | 3,31 | 53,45 | 6,88 |
| EMPA - sulfur black | 11,8 | 1,18 | 12,4 | 2,25 | 12,9 | 0,81 | 11,0 | 1,62 | 13,1 | 1,66 | 10,2 | 1,16 | 8,6 | 1,93 | 10,6 | 1,01 | 2,32 | 1,44 |

$n_i = 9$, $n = 72$, $k = 8$, $n - k = 64$, $F_1$; 64; 0,05 = 3,99
Sequence according to LSD
EMPA - standard 1-3-8-5-2-6-4-7
WFK - tea 3-1-2-6-5-8-7-4
WFK - seb. matter 8-6-5-1-3-2-4-7
EMPA - red wine 3-1-6-5-2-8-7-4
EMPA - sulfur black 5-3-2-1-4-8-6-7

TABLE 3

| Total result of the primary washing capacity (Test according to Wilcoxon-Wilcox) | | | | | | | | |
|---|---|---|---|---|---|---|---|---|
| | Recipe | | | | | | | |
| Stain | 1 | 2 | 3 | 4 | 5 | 6 | 7 | 8 |
| EMPA - standard | 1 | 5 | 2 | 7 | 4 | 6 | 8 | 3 |
| WFK - tea | 2 | 3 | 1 | 8 | 5 | 4 | 7 | 6 |
| WFK - sebaceous matter | 4 | 6 | 5 | 7 | 3 | 2 | 8 | 1 |
| EMPA - red wine | 2 | 5 | 1 | 8 | 4 | 3 | 7 | 6 |
| EMPA - sulfur black | 4 | 3 | 2 | 5 | 1 | 7 | 8 | 6 |
| Ranking sum | 13 | 22 | 11 | 35 | 17 | 22 | 38 | 22 |

| Difference D | | | | | | | |
|---|---|---|---|---|---|---|---|
| 1 | | 5 | | 2/6/8 | | 4 | 7 |
| 3 | 2 | 6 | | 11 | | 24 | 27 |
| 1 | | 4 | | 9 | | 22 | 25 |
| 5 | | | | 5 | | 18 | 21 |
| 2/6/8 | | | | | | 13 | 16 |
| 4 | | | | | | | 3 |

The underlined values are greater than the calculated value $D_{n=s}$; $k=8, \alpha.0.05=23.5$ in order that the condition of significance is met.
Sequence
3-1-5-2/6/8-4-7

TABLE 4

| Greying Degree of whiteness according to Berger, Δ values | | | | | | | | | | | | | | | | | | |
|---|---|---|---|---|---|---|---|---|---|---|---|---|---|---|---|---|---|---|
| Cotton | $\bar{x}_1$ | $\pm S_1$ | $\bar{x}_2$ | $\pm S_2$ | $\bar{x}_3$ | $\pm S_3$ | $\bar{x}_4$ | $\pm S_4$ | $\bar{x}_5$ | $\pm S_5$ | $\bar{x}_6$ | $\pm S_6$ | $\bar{x}_7$ | $\pm S_7$ | $\bar{x}_8$ | $\pm S_8$ | $S_{iN}^2$ | LSD |
| 10th wash | 25,2 | 0,36 | 25,6 | 0,12 | 26,5 | 0,06 | 20,7 | 0,18 | 24,2 | 0.36 | 24,9 | 0,10 | 21,8 | 0,16 | 26,3 | 0,00 | 0,04 | ,36 |
| 25th wash | 25,1 | 0,40 | 25,2 | 0,32 | 24,8 | 0,15 | 25,0 | 0,63 | 27,3 | 0,12 | 28,0 | 0,15 | 26,4 | 0,32 | 25,9 | 0,25 | 0,11 | 0,57 |
| Difference*) 10th/25th wash | −0,4% | | −1,6% | | −6,9% | | +17,2% | | +11,3% | | +11,1% | | +17,4 | | −1,5% | | | |

*)The difference refers to the 25th wash value
Sequence
25th wash 6-5-7-8-2-1-4-3

TABLE 5

| Incrustation (Loss due to burning [ignition loss] in percent) | | | | | | | | |
|---|---|---|---|---|---|---|---|---|
| | Cotton | | | | | | | |
| 10th wash | 2,5 | 2,3 | 2,3 | 3,1 | 2,4 | 1,5 | 3,6 | 2,4 |
| 25th wash | 3,8 | 4,2 | 4,4 | 6,8 | 3,8 | 2,7 | 6,6 | 4,0 |
| | Terry cloth | | | | | | | |
| 10th wash | 1,7 | 1,7 | 1,7 | 1,7 | 1,7 | 1,3 | 1,9 | 1,7 |
| 25th wash | 4,0 | 4,3 | 4,3 | 4,3 | 3,8 | 3,5 | 4,4 | 4,3 |

Further variations and modifications will become apparent to those skilled in the art and are intended to be encompassed by the apparent claims.

German priority application P 37 15 051 is relied on and incorporated herein.

We claim:

1. Phosphate-free detergent builder comprising a water-insoluble silicate capable of binding calcium ions and a mixture of two different acrylic acid homopolymers, wherein one of the homopolymers exhibits a viscosity number of 15 to 60 $cm^3/g$ and the other homopolymer exhibits a viscosity number of 80 to 200 $cm^3/g$.

2. Phosphate-free detergent builder according to claim 1 wherein the water-insoluble silicate is finely divided and has the following formula:

$$(Kat_{2/n}O)_x.Me_2O_3.(SiO_2)_y$$

wherein Kat is a cation with a valence of n which is replaceable by calcium, x is a number from 0.7 to 1.5, Me is boron or aluminum and y is a number from 0.8 to 6.

3. Phosphate-free detergent builder according to claim 2 wherein the said water-insoluble silicate is an aluminum silicate.

4. Phosphate-free detergent builder according to claim 3 wherein the aluminum silicate is amorphous or crystalline.

5. Phosphate-free detergent builder according to claim 3 wherein the aluminum silicate is powdery zeolite of type A.

6. Phosphate-free detergent builder according to claim 1 wherein the ratio of said one homopolymer to said other polymer ranges from between 1/99 and 99/1.

* * * * *